United States Patent [19]

Eriksson

[11] 4,299,305

[45] Nov. 10, 1981

[54] APPARATUS FOR DAMPING NOISE FROM EXHAUST AIR OUTLETS

[76] Inventor: Gunnar V. Eriksson, Högbyn, S-890 31 Arnäsvall, Sweden

[21] Appl. No.: 32,757

[22] Filed: Apr. 24, 1979

[30] Foreign Application Priority Data

May 12, 1978 [SE] Sweden ..... 7805502

[51] Int. Cl.[3] ..... F01N 1/10

[52] U.S. Cl. ..... 181/230; 181/256; 181/258

[58] Field of Search ..... 181/212, 224, 230, 252, 181/256, 258, 277, 282; 138/26, 108; 55/276; 173/DIG. 2; 415/119

[56] References Cited

U.S. PATENT DOCUMENTS

| | | | |
|---|---|---|---|
| 3,374,856 | 3/1968 | Wirk | 181/224 |
| 3,526,293 | 9/1970 | Hayes et al. | 181/230 |
| 3,601,219 | 8/1971 | Raschke | 181/230 |
| 3,957,133 | 5/1976 | Johnson | 181/256 |
| 4,121,686 | 10/1978 | Keller, Jr. | 181/252 X |
| 4,149,862 | 4/1979 | Sewell, Sr. | 181/258 X |

FOREIGN PATENT DOCUMENTS

| | | | |
|---|---|---|---|
| 275341 | 12/1970 | U.S.S.R. | 181/252 |

*Primary Examiner*—L. T. Hix
*Assistant Examiner*—Benjamin R. Fuller
*Attorney, Agent, or Firm*—Larson and Taylor

[57] ABSTRACT

A sound absorber or silencor for sound from outlets of air or gas comprising a tube or flexible hose (2) which is connected to an outlet (1) of air or gas and which contains a sound absorbing body (3), whereby the tube or hose (2) and the sound absorbing body (3) can move more or less freely in relation to each other and/or in which the tube or hose (2) together with the sound absorbing body (3) is made easily flexible. Preferably both the outer hose (2) and the sound absorbing body are flexible and the sound absorbing body is movable inside the hose (2). The sound body (3) can be a strong, threads, fibres, loops etc. of plastic, metal, natural fibres or similar material.

11 Claims, 7 Drawing Figures

APPARATUS FOR DAMPING NOISE FROM EXHAUST AIR OUTLETS

Figure 1:
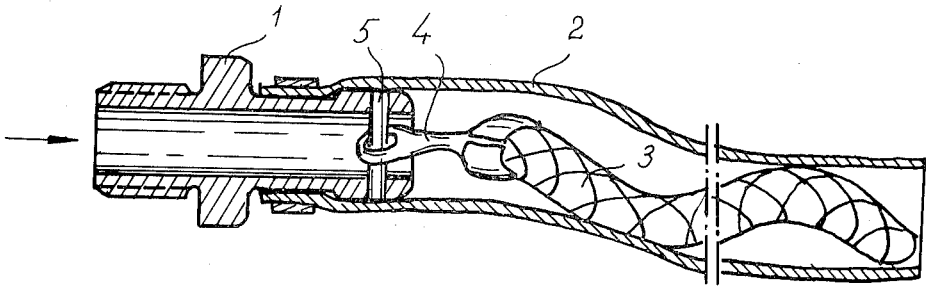

A sound absorber or silencer for sound from gas outlets comprising a tube or flexible hose which is connected to a gas outlet and which contains a sound absorbing body, whereby the sound absorbing body can move freely in relation to the tube and in which the tube together with the sound absorbing body is made easily flexible. Preferably both the tube and the sound absorbing body are flexible and the sound absorbing body is movable inside the hose. The sound absorbing body can be a string, threads, fibres, loops etc. of plastic, metal, natural fibres or similar material.

The said type of outlets, are also disadvantageous in that it may cause hearing defects in the air contains oil and lubricant additives and small particles of wear from the tool. Late investigations have proved that breathing such oil mist may among other things give serious allergic diseases. Since the oil mist sets as a fatty or oily layer also the risk of slipping increases in the vicinity of the outlet point.

The existing method of removing the above mentioned noise problems is to provide a so called diffusor damper or silencer inations of said materials. The air speed at the outlet surface of the porous material thereby becomes so low that the sound generation is reduced to a great extent. From time to time other solutions of the problem have also appeared, such as guiding the outlet air from several outlets into a separate sound damper of the absorption type by means of hoses or guiding the air to an area where there are no people. There are also special filters/sound dampers which have a good cleaning/sound damping effect. For economical reasons and since such apparatus are voluminous this type of apparatus is, however, unusual. In Sweden there are a great number of groups working minimize noise within various working fields. The acoustic analysis thereby were made by the leading acoustic consulting agents in the country or at the technical high schools. Many of said groups have worked on the problems concerning air outlets and have published articles concerning the problems and possible solutions thereof. In spite of said qualified work no new solutions have appeared over the above described ones.

The first mentioned sound damper or silencer of the diffusor type which are dominating the market have, however, a very serious disadvantage: There is a great counter-pressure over the dampers. Therefore such dampers are not allowed in pneumatically actuated presses (for safety reasons) and also they cannot be used as dampers for brake valves for instance in buses or lorries. In the latter case the braking distance is increased if dampers are used, and this, of course, cannot be accepted. Even in more ordinary applications this type of damper causes problems in that the oil mist and particles of dirt to an increasing degree seal the porous damper structure. The design of movement of for instance an air pressure driven cylinder thereby becomes so changed that the damper must be cleaned or discarded after a short period. It can be mentioned that the so called "working group against noise in the workshop industry" has published a special statement, number 8 of 1975, in which is suggested that the manufacturers of diffusor sound dampers should state the pressure losses for different air flows in order that the designers of pneumatical plants shall be able to choose the correct components.

The object of the present invention is to provide an apparatus giving the necessary sound damping and having a low counter-pressure and which is, in combination therewith of such simple structure that the manufacturing cost is low. Also the sound damper according to the invention should be formed so that it can be mounted anywhere without difficulties.

The sound damper comprises a tube or a flexible hose which is connected to the air outlet. In the said tube or hose there are one or more elongated flexible bodies having such porosity that the high frequence sound is damped effectively by spreading itself in the hose. The elongated bodies should have a cross sectional area which in total is sufficient to give a high absorption of the most disturbing tones. Since large air flow areas provide a displacement of the noise spectrum towards low tones a more coarse absorbing material is necessary than in small air flow areas. The remaining volume in the hose is used as a channel for the outflowing air. The reduction in air speed in the said channel is kept so low that the counter pressure is neglectable. According to a suitable balancing of the relationships between the cross section areas of the absorption body and the flow channel the total cross section area of the absorption body should be in the magnitude of about half the total inner cross-sectional area of the hose. High frequency sound which are of interest in this connection are poorly damped when passing through channels having a free flight opening. According to the invention this problem is eliminated in that the absorption body is flexible. If the absorption body is made of an easily flexible material the air flow provides a movement of the absorption body so that the said body contacts the outer tube or outer hose at many different points or in other words so that the geometry of the absorption body is changed irregularly in case there is a need for such changes. When manufacturing absorption bodies of a heavy or stiff material it may be formed to prevent a free flight opening. If the absorption body is mounted at or adjacent the tube wall or the hose wall the said tube or hose preferably should be made of an easily flexible material so that the said prevention of free flight opening is provided by the fact that the tube or hose keeps bending.

A further essential property of the flexible absorbtion body is obtained in combination with an easily flexible outer tube or hose: The entire damper thereby can be bent and mounted as found most convenient for each particular machine.

In extreme cases the outflowing air is cooled so heavily that the water steam of the air freezes to ice. The above mentioned non-movable diffusor dampers may be sealed for that reason. The flexible absorption body of the present invention, on the other hand, can move by the actuation of the outflowing air and thereby provide the valuable advantage of continuous de-icing of any ice which has been formed on said body.

The object of the outer tube or hose is substantially to provide a long passageway. The sound insulation of the tube must be sufficiently good that the damping is not reduced because of sound passing through the tube walls. This demand is fulfilled by most tubes of metal or synthetic resin.

As mentioned the inner absorption body should be flexible and porous. As examples of such bodies which can be mentioned:

foam plastic which may be surrounded by a spun thread stocking, a body of spun or pleated thread (metal or fibre), a large number of thin longitudinal threads (fibre or metal), a large number of radially inwardly directed threads or bundles of fibres.

The tube together with its porous flexible inner absorption body acts as a sound absorbing channel which is very effective since a free flight opening is prevented by movements of the flexible absorption body and/or a flexible outer tube or outer hose.

When the outlet air expands into the sound damper tube (practically to atmospheric pressure) the temperature is strongly lowered and the oil mist tends to condense on the available surfaces, namely on the inner surface of the tube and on the surface of the absorption body. Drops of increasing size are collected on said surfaces and are successively transported towards the outlet end by the air flow and the oil leaves drop by drop at said outlet end of the tube.

The invention will be described below in greater detail in connection with several embodiments thereof, each of which are illustrated in a longitudinal cross section in the accompanying FIGS. 1–7. In the different figures the same parts are given the same reference numbers.

Figure 2:
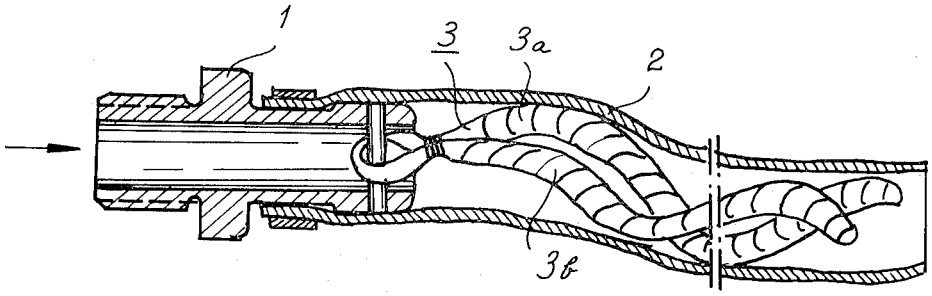
Figure 3:
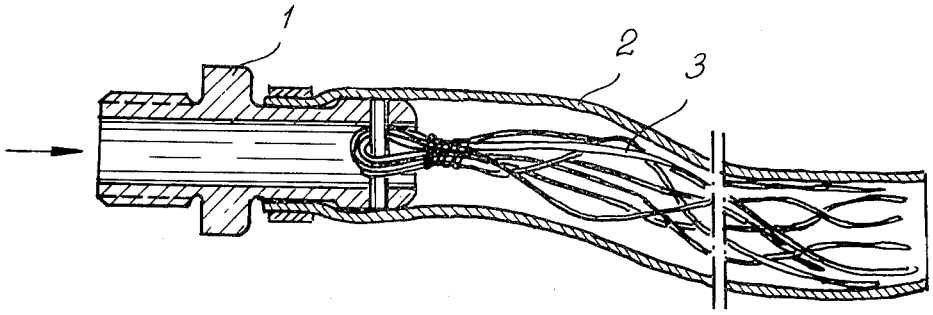

The apparatus illustrated in FIGS. 1–3 is connected to a nipple 1 through which air flows as illustrated by the arrows. The damping apparatus comprises a flexible hose or a flexible tube 2 which is clamped on the nipple 1 by a hose clamp or similar means. The hose or tube 2 can be made of plastic, rubber or any other flexible material. In the hose 2 an absorbing body 3 is mounted, and the said absorbing body is preferably formed with a retainer 4 at one end which is movably connected to a cross pin 5 of the nipple 1. The absorbing body 3 is flexible and may consist of a length of plastic, for instance foam plastic which is surrounded and reinforced by a pleated stocking. The absorbing body which may have any cross sectional form such as rectangular, tube-formed, polygonal etc. is freely movable independently of the movements of the tube or hose 2.

FIG. 2 illustrates that the sound absorbing body can be formed with two freely movable parts 3*a*, 3*b* which can be of different lengths, and FIG. 3 illustrates that the sound absorbing body 3 may consist of a large number of thin threads.

Figure 4:
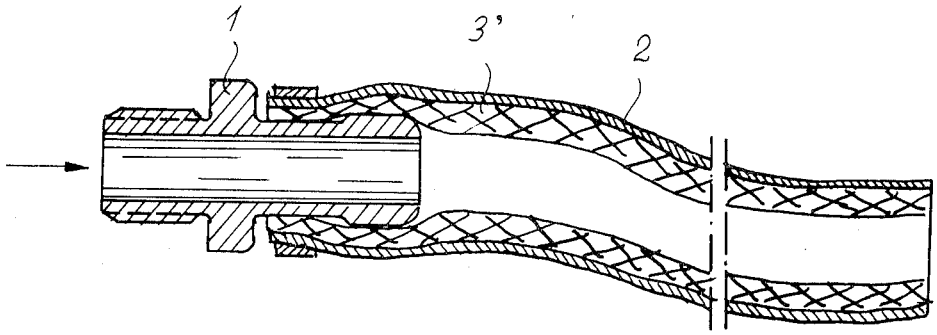

FIG. 4 illustrates that the sound absorbing body may consist of a hose or tube 3' of any soft material such as foam plastic, natural fibre or any other material which can move together with the flexible outer tube 2. In this case the sound absorbing body 3' is mounted on the nipple 1 together with the outer tube 2. The hose 3' of sound absorbing material may have substantially the same outer diameter as the inner diameter of the outer tube 2, or the sound absorbing hose 3' may have a slightly less diameter than the inner diameter of the outer tube but is formed so that it can expand as far as the dimension of the outer tube 2 depending on the pressure of the outflowing air or gas.

In the case wherein the outer tube 2 is non-flexible or only slightly flexible it is preferably preformed so that the air cannot freely flow through the tube, or in other words so that a free flight opening through the tube is prevented.

Figure 5:
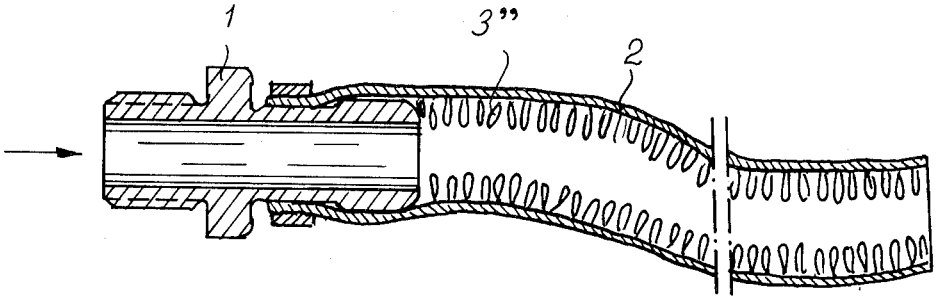

FIG. 5 illustrates an alternative embodiment of the apparatus of FIG. 4 in which the sound absorbing body 3'' is made of fibres, threads, bundles of fibres, eyelets or similar of plastic, metal, natural fibres or similar extending radially inwardly from the outer tube or hose 2. The said fibres, threads or eyelets can be mounted directly at the outer hose 2 or can be connected by means of an inner stocking which in turn contacts or is mounted in the outer hose 2.

Figure 6:
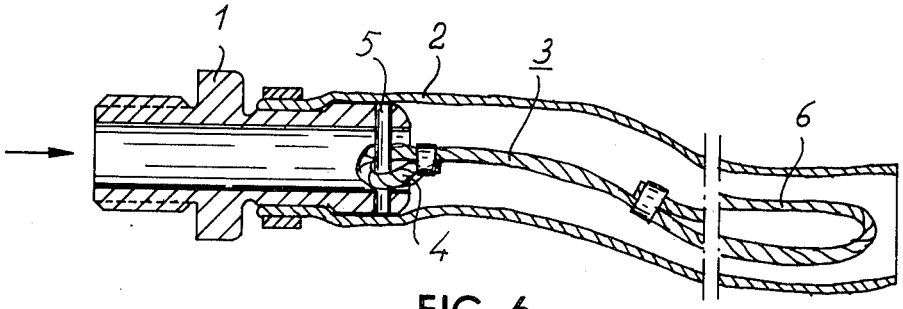
Figure 7:
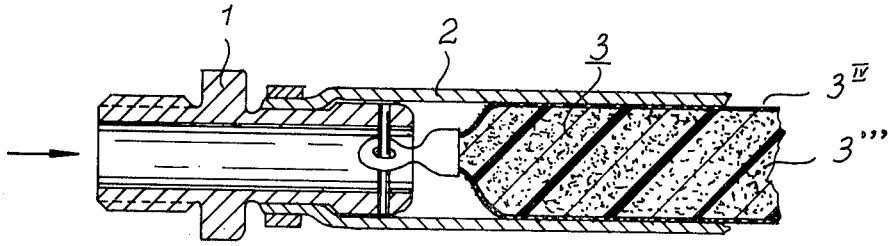

The absorption body can be given different cross sectional area in relation to the outer tube, and in FIGS. 6 and 7 are illustrated a couple of different embodiments, in which the cross section area of the absorption body is made relatively, small, and relatively large respectively.

FIG. 6 illustrates an embodiment of the invention in which the absorbing body 3 at the outer end is double-folded to provide a sling 6 about half way out from the nipple 1.

FIG. 7 illustrates an embodiment in which the absorbing body is made of foam plastic 3''' enclosed with a spun stocking $3^{IV}$ and in which the absorbing body substantially fits the hose 2. The absorbing body 3 is self-controlling of the pressure of the outlet air since the absorbing body can expand axially upon increasing pressure.

It is to be understood that the above described embodiments of the invention illustrated in the drawings are only of exemplifying character and that the invention is only restricted by the appended claims.

I claim:

1. An exhaust muffler for a pneumatic motor, comprising:

a flexible conduit section of an exhaust passage connected to the motor, flexible absorption means, located in said flexible conduit section, comprising at least one flexible absorptive element, said flexible absorptive element comprising a substantially solid core of an elastic porous material enclosed in a flexible perforated envelope and having an outer diameter considerably less than the inner diameter of said flexible conduit section, thereby leaving an annular exhaust air passage past said at least one flexible absorptive element and between said flexible conduit section and said at least one flexible absorptive element, and means coupled to said flexible absorptive means for securing said absorptive means against longitudinal movement thereof in said flexible conduit section.

2. An apparatus for damping sound in a gas outlet comprising, a tube having its inlet end connectable to a gas outlet, said tube also having an outlet end, an elongated body formed of sound absorbing material and being bendable or flexible, said body being connected at a connection point in said tube, extending from said connection point towards the tube outlet, and being freely movable downstream from said connection point back and forth across the cross-sectional area of the tube as gas flows therethrough toward the tube outlet.

3. An apparatus according to claim 2, said tube being a flexible tube.

4. An apparatus according to claim 2 or claim 3, said sound absorbing body being string-like, the outer dimensions of said body being less than the interior cross-sectional area of the tube, and wherein said connection point is at or close to the said gas outlet.

5. An apparatus according to claim 4, wherein said string-like body is formed with two strands.

6. An apparatus according to claim 4, wherein the string-like body includes several freely movable strands, all connected together at said connection point and being freely movable in relation to each other within the tube.

7. An apparatus according to claim 2 or claim 3, wherein the sound absorbing body is made of a synthetic resin material, a natural fibre, metal or similar material.

8. An apparatus according to claim 2 or claim 3, wherein the sound absorbing body is made of foam resin which is surrounded by a spun thread stocking.

9. An apparatus according to claim 2 or claim 3, wherein the string-like body is double-folded at the end thereof opposite the said outlet about half way between the two ends of the sound absorbing body to provide a loop at the outer end of the sound absorbing body and inside of the tube.

10. An apparatus according to claim 2 or claim 3, said tube comprising a nipple insertable into the said gas outlet, a hose member connected to said nipple, and a rigid pin connected to said nipple and extending transversely thereacross, said connection point comprising the connection of said absorbing body to said pin.

11. A pneumatically actuated device including a gas outlet, and including an apparatus for damping sound according to claim 2 connected to said outlet.

* * * * *